United States Patent [19]

Reed

[11] 4,166,484

[45] Sep. 4, 1979

[54] METHOD AND APPARATUS FOR MIXING GASES IN A CLOSED CHAMBER

[75] Inventor: Thomas F. Reed, Akron, Ohio

[73] Assignee: The General Tire & Rubber Company, Akron, Ohio

[21] Appl. No.: 871,065

[22] Filed: Jan. 20, 1978

[51] Int. Cl.[2] ..... B65B 31/02

[52] U.S. Cl. ..... 141/4; 53/408; 53/86; 141/51; 156/146; 273/61 D; 425/446

[58] Field of Search ..... 29/463; 53/7, 86; 141/1, 4, 5, 8, 9, 11, 51, 65, 66, 63, 114, 324, 329, 392; 156/146; 206/315 B; 273/61 D; 425/446

[56] References Cited

FOREIGN PATENT DOCUMENTS 2028096 12/1971 Fed. Rep. of Germany ..... 141/5

*Primary Examiner*—Richard E. Aegerter
*Assistant Examiner*—Frederick R. Schmidt

[57] ABSTRACT

A method and apparatus are provided for rapidly distributing a first gas throughout a chamber that contains both the first gas and a second gas. The invention is particularly useful in the pressurizing of tennis ball centers with a low permeability gas, where the diffusion rate between the low permeability gas and air is very slow. By this invention, the distribution of the low permeability gas throughout the mold can be accomplished in a much shorter period of time by a mechanical mixing method and apparatus that involves circulating the mixture of gases inside the mold through a conduit and pump located outside the mold.

14 Claims, 3 Drawing Figures

METHOD AND APPARATUS FOR MIXING GASES IN A CLOSED CHAMBER

CROSS-REFERENCES TO RELATED APPLICATIONS

This invention relates to the pressurizing of tennis balls with a low permeability gas, as described in U.S. application Ser. Nos. 627,721, filed Oct. 13, 1975, and now issued as U.S. Pat. No. 4,098,504, dated July 4, 1978 and No. 821,002 filed Aug. 1, 1977, and presently pending. Both of the foregoing applications, and this application as well, are assigned to The General Tire & Rubber Company.

BACKGROUND OF THE INVENTION

The present invention relates generally to the pressurizing and mixing of gases in a closed chamber, and more particularly to the pressurizing and mixing of a low permeability gas with air in a tennis ball center just prior to the joining of two halves of the center together to form a complete pressurized ball.

The pressurizing of tennis ball centers with a low permeability gas such as sulfur hexafluoride or perfluoropropane is set forth in the above mentioned related applications. The advantage of using such low permeability gases is that they do not permeate out of the tennis balls as readily as air, and consequently they result in tennis balls that have longer playing lives.

However, in order for the low permeability gases to be effective as a commercially feasible way of increasing the playing life of tennis balls, the gas must be distributed fairly evenly throughout the mold. Otherwise, only a portion of the tennis balls produced will receive enough low permeability gas to effectively increase their playing lives. Also, customers receiving a good set of balls on one occasion are likely to be disappointed on a future occasion when they receive a set of balls that do not have as much low permeability gas.

A particular problem with sulfur hexafluoride and other low permeability gases is that, being heavier than air, they tend to stratify in the air already in the mold and collect in the mold cavities nearest the point in the mold where they are introduced. Eventually, the gases do mix by diffusion, but this process takes a long time, as much as 10 or more minutes, to achieve a satisfactory gas distribution throughout all the mold cavities.

It is not desirable to solve this problem by premixing the low permeability gas with the air and introduce the mixture into an evacuated mold, because when the mold is evacuated, the residual air trapped between the ball halves and the surfaces of the mold cavities tends to force the ball halves out of the cavities. It is then impossible for these ball halves to be properly pressurized or joined to each other by the closing of the mold sections after the pressurization step. Another method tried for mixing the gases in the mold is bumping the mold after pressurizing it. However, such bumping has not proven effective in reducing the mixing time to an appreciable extent. Also, bumping the mold can break the seal around the peripheries of the mold sections, which results in lower ball center pressures as well as a loss of valuable gas.

SUMMARY OF THE INVENTION

According to the method of subject invention, the foregoing problems in distributing a first gas throughout a chamber containing a mixture of the first gas and a second gas are solved by withdrawing the mixture of gases through a first port in the chamber and pumping the mixture back into the chamber through a second port distant from the first port to cause the mixture flow throughout the chamber, this withdrawal and pumping of the mixture of gases out of and into the chamber being continued until the first gas is distributed to the desired degree of uniformity throughout the chamber.

According to the apparatus of the subject invention, a conduit is provided communicating at one end with a first port in the chamber containing the gases to be mixed and communicating at its other end with a second port in the chamber that is distant from the first port. Thus, a closed loop is formed for circulating the mixture of gases through both the chamber and the conduit. A pumping means is also provided in the conduit for effecting this circulation of gases.

Both the method and apparatus of this invention are particularly applicable to the mixing of a low permeability gas such as sulfur hexafluoride with air in a mold designed for pressurizing tennis ball centers and joining together the halves of these centers after such pressurization.

The foregoing features and objects of this invention will be more apparent from the following detailed description and the attached drawings.

DETAILED DESCRIPTION

Figure 1:
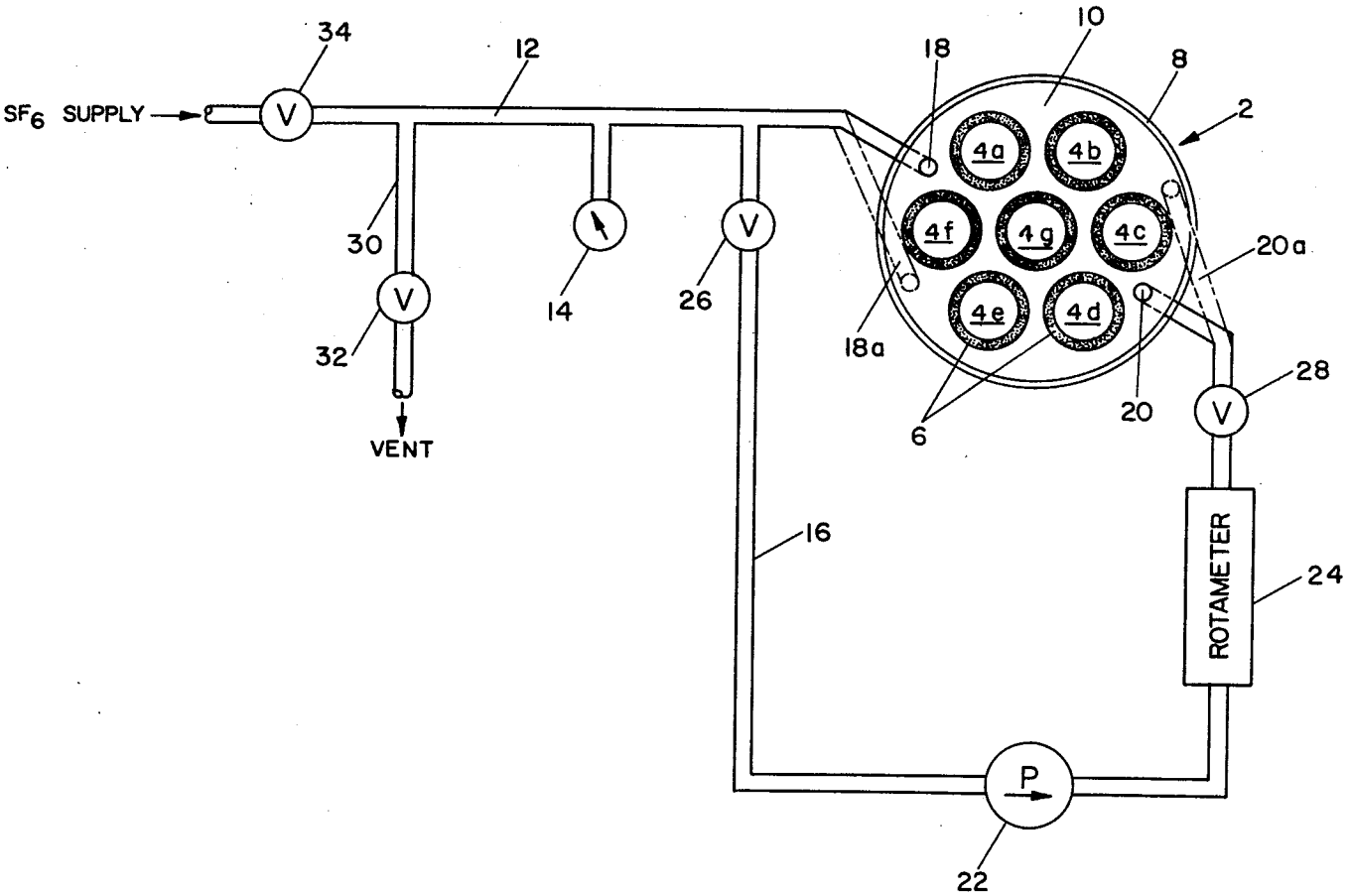
Figure 2:
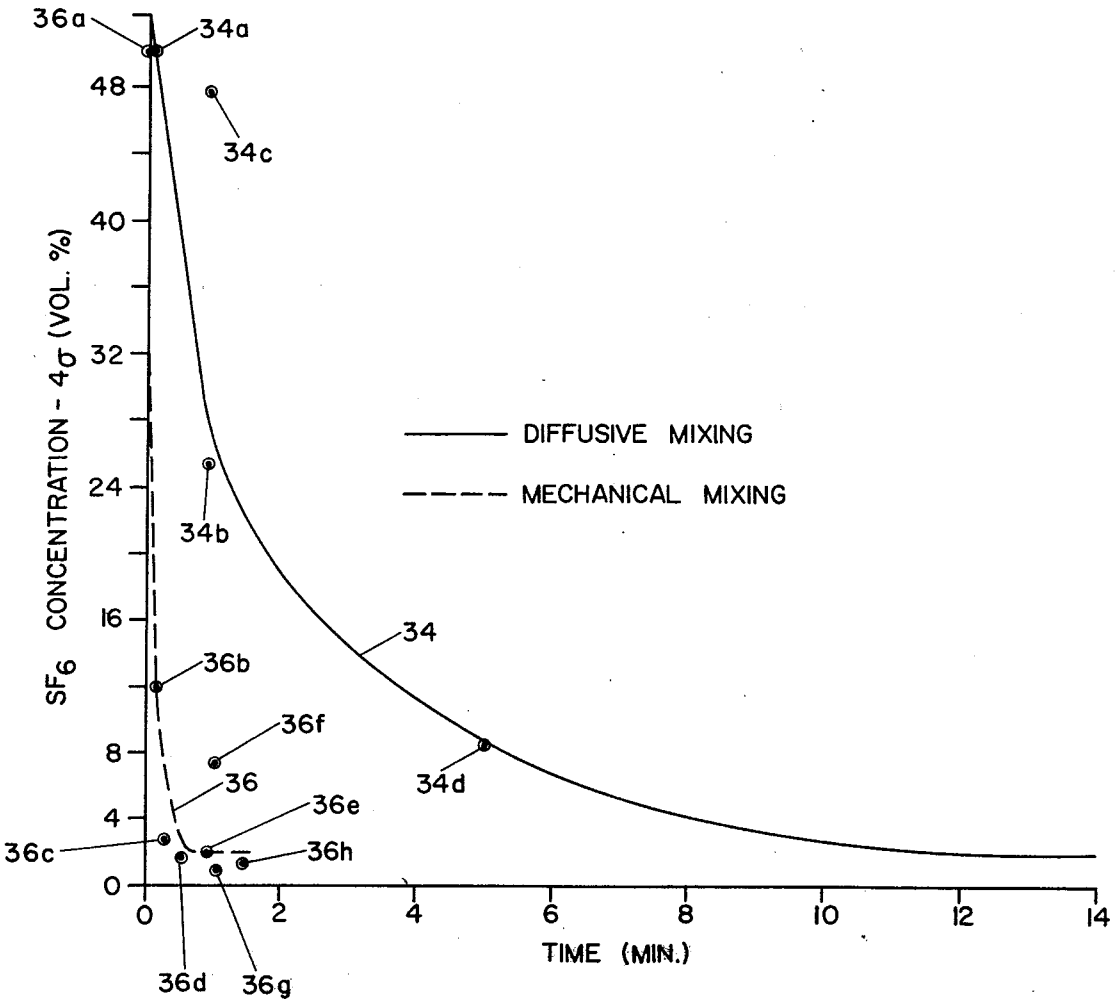
Figure 3:
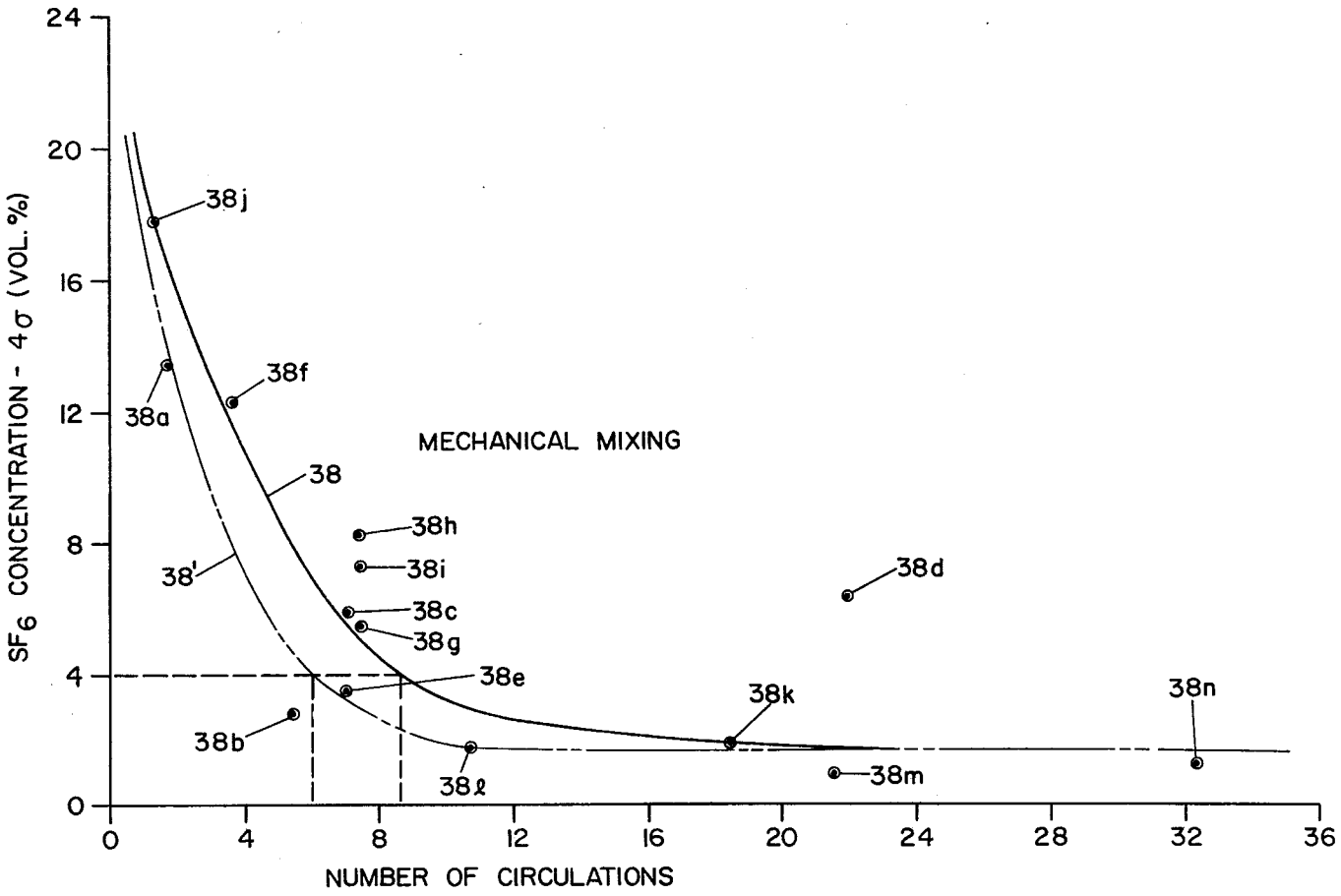

In the attached drawings:

FIG. 1 is a diagrammatic view of an apparatus for pressurizing tennis ball centers, illustrating the subject invention;

FIG. 2 is a graph showing a comparison between the time required for conventional diffusive mixing of gases in tennis ball molds, and the time required for the mechanical mixing of gases by the apparatus of FIG. 1; and FIG. 3 is a graph showing the degree of mixing of gases attained by the subject invention as a function of the number of circulations of said gases performed by the apparatus of FIG. 1.

Referring to the diagrammatic representation of the apparatus in FIG. 1, the bottom side of a top mold section 2 is shown with mold cavities 4, labelled individually 4*a*, 4*b*, 4*c*, 4*d*, 4*e*, 4*f* and 4*g*. Top tennis ball center halves 6 having adhesive coated edges 7 are lodged in these mold cavities 4. Around the periphery of the top mold section 2 is a sealing element 8 that engages another sealing element on the outer periphery of a bottom mold section, not shown.

The bottom mold section is similar to the top mold section 2, and has bottom tennis ball halves, not shown, that are lodged in cavities directly beneath the cavities 4 in the top mold section 2. As is conventional in molding apparatus for joining tennis ball halves together, the top mold section 2 initially engages the bottom mold section with its peripheral sealing element 8 to form a chamber 10, while the edges of the ball halves within the mold cavities of both mold sections are left spaced from each other a small distance. In other words, the circular edges of the ball halves are near to but not engaging each other, while the peripheral edges of the mold sections engage each other to form the chamber 10 that is sealed so that it can be pressurized. The foregoing features of the apparatus of FIG. 1 are conventional and are found in most molds that are designed for pressurizing the space within tennis ball halves and then joining these halves together to form a complete pressurized ball.

The chamber 10 is designed to be pressurized, usually with air, through a means such as conduit 12 that is shown in FIG. 1 communicating with the chamber 10 through a portion of another conduit 16. In order to reduce the loss of air pressure in the tennis balls after they are formed, however, it is desireable to replace the air introduced through the conduit 12 with sulfur hexafluoride ($SF_6$), or alternatively perfluoropropane ($CF_3CF_2CF_3$), or another gas having a lower permeability than air through the walls of tennis ball halves 6. This low permeability gas is pumped into the chamber 10 to the desired pressure level as indicated on pressure gauge 14. For example, a desired pressure for a mixture of $SF_6$ gas and air would be about 100 kPa gauge, so that the concentration of $SF_6$ within the chamber 10 would be approximately 50% by volume.

The problem which is solved by this invention is that the air and $SF_6$ or other low permeability gas do not mix very rapidly by diffusion. Thus, if the tennis ball center halves were joined together without allowing the necessary time for diffusive mixing and without some employing kind of mechanical mixing, the concentration of low permeability gas would be very high in the tennis balls in the mold near where the gas is introduced to the mold, and it would be very low in the tennis balls distant from this location. Only a few balls would have the long-life advantages provided by pressurizing the balls with the low permeability gas.

To solve this problem, a gas recirculating conduit 16 is provided. Through the conduit 16, the mixture of gases in chamber 10 is withdrawn through a port 18 in the top mold section 2, and is pumped by a pump 22 back into the chamber 10 through a port 20 that is distant from the port 18. For thorough mixing of the gases throughout the chamber 10, the port 20 should be on the opposite side of the chamber 10 from the port 18, so that all parts of the chamber 10 will be mixed by the flow of gases between the ports 18 and 20.

In large molds, the mixing of the gases in chamber 10 may be enhanced by providing legs **18*a* and 20*a* on the conduit 16 so that the gases are withdrawn from chamber 10 through a plurality of ports and are pumped back into the chamber 10 through a plurality of ports. In addition to the pump 22, there is also preferably a rotameter 24 or another type of flowmeter in the conduit 16 for the purpose of measuring the flow rate of the gases being circulated. This flow rate can then be used to calculate how many times the gas mixture in the chamber 10 is being circulated in a given length of time. The total volume of mixture passing through the rotameter 24 should be at least six and preferably at least eight times the combined volume of the chamber 10, the conduit 16, the pump 22, and all other equipment through which the mixture passes, including the rotameter 24** itself.

In operation, a low permeability gas such as sulfur hexafluoride is pumped into the chamber 10 with valves 26 and 28 in the conduit 16 closed. Also closed is valve 32 in vent line 30. When the desired pressure level is reached as indicated by gauge 14, valve 34 in conduit 12 is closed and valves 26 and 28 in conduit 16 are opened. Then, pump 22 withdraws the mixture of gases in chamber 10 through port 18 and pumps it back into chamber 10 through port 20. The low permeability gas thus becomes rapidly distributed throughout the chamber 10 by being continuously circulated through a path that causes the gas to flow from the port 20 on one side of the chamber 10 across to the port 18 on the other side of the chamber 10. After enough time for about eight circulations of the gas mixture, as determined by the gas flow rate measured by the rotameter 24, the valves 26 and 28 are turned off again. The mold sections are then closed to join together the tennis ball halves, and the gas trapped within the chamber 10 but outside the joined tennis ball halves is vented by opening valve 32 in vent line 30.

The improved rapidity with which the foregoing method and apparatus distributes the low permeability gas throughout the chamber 10 has been demonstrated by means of standard deviation analysis of the variations in concentrations of sulfur hexafluoride among the tennis balls produced both by conventional diffusive mixing of the gases and by mechanical mixing using the apparatus and method described above. The results of these tests and analyses are shown in FIGS. 2 and 3 of the attached drawings.

In any mixture of 50% by volume sulfur hexafluoride and 50% by volume air, there is bound to be some variation in the exact concentration of sulfur hexafluoride in different parts of the mold chamber. For statistical purposes, this variation can be defined by the familiar standard deviation $\sigma$, which is determined by the following formula:

$$\sigma = \sqrt{\frac{\Sigma(x_i)^2 - (\Sigma x_i)^2/n}{n-1}}$$

where $x_i$ = the concentration of sulfur hexafluoride in each sample made at one time in chamber 10 (FIG. 1) and n = the number of samples taken.

The standard deviation is a numerical measure of the distribution of sulfur hexafluoride concentrations around the average value of sulfur hexafluoride concentrations for each collection of samples. If the distribution is wide and spreads over a large area on either side of the value for average concentration, then $\sigma$ is large. Conversely, narrow distributions of sulfur hexafluoride concentrations yield correspondingly low values of $\sigma$ which indicate that the concentrations of most of the samples fall close to the average concentration.

For a Gaussian-shaped curve, to which many distributions are very similar, a spread of concentrations equal to $4\sigma$ is enough to include about 95% of the samples. With tennis balls filled with sulfur hexafluoride, it has been estimated that an 8% range in the useful life 95% of these tennis balls can be tolerated. This translates into an acceptable 8% range in sulfur hexafluoride concentration. Since the balls will be filled with a 5% concentration sulfur hexafluoride, an 8% range in this concentration would mean an acceptable spread of 4% by volume sulfur hexafluoride concentration in the balls.

With the forgoing goal in mind, tests were performed to determine how long it took for sulfur hexafluoride to become distributed throughout air by means of diffusion and by means of mechanical mixing with the apparatus and method of this invention. For the diffusive mixing tests, a seven cavity mold of the configuration shown in FIG. 1 was pressurized with sulfur hexafluoride to a volume concentration of about 50% sulfur hexafluoride.

During this pressurization the mold halves were held with their platens 5.59 mm. apart, but with their outer peripheries in sealing engagement with one another. Then the tennis ball halves were joined together after varying time intervals to produce several sets of seven balls, each set of which had varying degrees of uniform distribution of sulfur hexafluoride. The $4\sigma$ concentration spread for each set was then calculated using the formula for $\sigma$ set forth above. The results of these tests are set forth in Table I:

TABLE I

DIFFUSIVE MIXING OF $SF_6$

| Set No. (7 balls each) | Time Allowed for Diffusion (minutes) | $4\sigma$ Spread in $SF_6$ Concentration (% vol.) |
|---|---|---|
| 34a | 0 | 52.0 |
| 34b | 1 | 25.7 |
| 34c ($SF_6$ added slowly) | 1 | 47.6 |
| 34d | 5 | 8.61 |
| 34e | 30 | 1.83 |

It was noted that sample 34c showed that introducing the sulfur hexafluoride into the mold at a slow rate hindered the distribution of the sulfur hexafluoride throughout the mold, but that even with a rapid introduction of sulfur hexafluoride, the time required to achieve a $4\sigma$ concentration spread of 4% was quite high. As curve 34 in FIG. 2 shows, a diffusion period of about 10 minutes must be allowed to achieve the desired 4% spread in sulfur hexafluoride concentration.

Another series of tennis ball sets were prepared in the same seven ball mold, but instead of allowing the sulfur hexafluoride to mix by diffusion alone, valves 26 and 28 (FIG. 1) were opened, and the sulfur hexafluoride and air mixture in the chamber 10 were pumped by pump 22 at a flow rate of 0.61 cubic feet per minute (17 liters/-min.). This process was performed on each of several sets of balls for varying lengths of time before the mold halves were closed to join the ball halves together. The $4\sigma$ concentration spread for each set of balls was then calculated, and the results of these tests are set forth in Table II:

TABLE II

MECHANICAL MIXING OF $SF_6$

| Set No. (7 balls each) | Time Allowed for Mixing (minutes) | $4\sigma$ Spread in $SF_6$ Concentration (% vol.) |
|---|---|---|
| 36a | 0 | 52.0 |
| 36b | 0.167 | 12.0 |
| 36c | 0.25 | 2.84 |
| 36d | 0.5 | 1.70 |
| 36e | 0.833 | 1.92 |
| 36f | 1.00 | 7.44 |
| 36g | 1.00 | .95 |
| 36h | 1.50 | 1.26 |

These tests are plotted on the dotted line curve 36 in FIG. 2 and show a great improvement in the rapidity with which sulfur hexafluoride gas can be distributed using the mechanical mixing apparatus and method of this invention. In fact the desired $4\sigma$ spread of sulfur hexafluoride concentration equal to 4% can be attained in well under 30 seconds. The only experiment that suggested that more time might be required was with set number **36*f***, but it is believed that the result of that test was in error, since it differs so widely from the results of other tests conducted with the same or very close to the same mixing times.

The time required to distribute the sulfur hexafluoride to its desired $4\sigma$ concentration can of course be improved by increasing the flow rate induced by the pump 22. Actually, the critical factor in determining the extent of sulfur hexafluoride distribution using mechanical mixing has been found to be not the time alone, but the number of circulations of the mixture. One circulation of the mixture means the pumping of an amount of gas mixture equal to the combined volume of the chamber 10, conduit 16, pump 22, and any other equipment through which the mixture is passed. The $4\sigma$ variation in concentration of sulfur hexafluoride has been found to be very closely related to the number of circulations through which the mixture has been put. A series of test sets of tennis balls were made with varying numbers of gas circulations before the tennis ball halves were joined together. The results of these tests are set forth in Table III:

TABLE III

MECHANICAL MIXING OF $SF_6$ AS A FUNCTION OF NUMBER OF CIRCULATIONS

| Set No. (7 balls each) | Number of Circulations | $4\sigma$ Spread in $SF_6$ Concentration (% vol.) |
|---|---|---|
| 38a | 1.8 | 13.2 |
| 38b | 5.5 | 2.8 |
| 38c | 7.2 | 5.9 |
| 38d | 22.0 | 7.4 |
| 38e | 7.1 | 3.5 |
| 38f | 3.7 | 12.2 |
| 38g | 7.6 | 5.5 |
| 38h | 7.6 | 8.2 |
| 38i | 7.6 | 7.3 |
| 38j | 1.4 | 17.6 |
| 38k | 18.5 | 1.9 |
| 38l | 10.8 | 1.7 |
| 38m | 21.6 | 0.95 |
| 38n | 32.5 | 1.3 |

These results are plotted on the graph of FIG. 3 in the form of experimental points **38*a* . . . 38*n*. A curve 38 is drawn through the center of these experimental points and shows that slightly more than 8 circulations will produce the desired $4\sigma$ sulfur hexafluoride concentration of 4% by volume. There is some variance in the experimental results and it is possible that a curve as low as dashed curve 38**[1] could be drawn through the experimental points, leading to the conclusion that as low as 6 circulations could product a $4\sigma$ sulfur hexafluoride concentration. Of course, whether 6 or 8 circulations are deemed sufficient, it should be borne in mind that these results are based on experiments with a 7 cavity experimental mold, and that more circulations might well be necessary for larger commercial molds.

The foregoing results demonstrate that mechanical mixing by circulating the gas mixture through a conduit outside the mold is definitely superior to allowing the gases to diffuse by themselves inside the mold. In fact it has been shown that a mixing time of up to 10 minutes necessary for proper mixing by diffusion can be cut to within 10 to 30 seconds by means of the mechanical mixing method and apparatus of this invention.

While the foregoing method and apparatus represent one embodiment of this invention, modifications and other embodiments will of course be apparent to those skilled in the art, without departing from the scope of the following claims.

What is claimed is:

1. A method of rapidly distributing a first gas throughout a chamber that contains a mixture of said first gas and a second gas and is sealed from the atmosphere, said chamber being defined by the sections of a mold for joining together ball halves and by a plurality of said ball halves lodged in cavities in said mold sections, and said mold sections having been closed to a position in which the edges of said ball halves are near to but not engaging each other and in which the outer peripheries of said mold sections are in sealing engagement with one another, comprising the steps of withdrawing said mixture of gases through a first port in said chamber and pumping said mixture of gases into said chamber through a second port distant from said first port to cause a flow of said mixture throughout said chamber, said withdrawal and pumping being continued until said first gas is distributed to the desired degree of uniformity throughout said chamber.

2. The method according to claim 1 wherein said first gas has a lower permeability through said ball halves than air and said second gas is air, and said withdrawal and pumping of said mixture of gases is continued until the volume of said mixture so withdrawn and pumped is at least six times the combined volume of said chamber and all conduits and other chambers through which said mixture is withdrawn and pumped.

3. The method according to claim 2 including the steps measuring the flow rate of said mixture of gases being withdrawn and pumped and continuing said withdrawal and pumping of said mixture of gases for a length of time sufficient for the desired volume of said mixture to be withdrawn and pumped at the flow rate thus measured.

4. The method or improvement according to claim 2 wherein said first gas having a lower permeability through said tennis ball centers than air is sulfur hexafluoride.

5. In a method of pressurizing balls wherein two mold sections containing mold cavities in which are lodged halves of said balls are closed to a position in which the edges of said ball halves are near to but not engaging each other and in which the outer peripheries of said mold sections are in sealing engagement with one another, and a gas other than air is introduced into the sealed-off chamber between said mold sections to mix with the air inside said sealed-off chamber, the improvement of rapidly distributing said gas throughout said sealed-off chamber comprising the steps of withdrawing said gas and air mixture through a first port in said sealed-off chamber and pumping said mixture into said chamber through a second port in said sealed-off chamber distant from said first port so as to cause a flow of said mixture throughout said sealed-off chamber, said withdrawal and pumping being continued until said gas is distributed to the desired degree of uniformity throughout said sealed-off chamber.

6. The improvement according to claim 5 wherein said gas other than air has a lower permeability through said ball halves than air, and said withdrawal and pumping of said mixture of gases is continued until the volume of said mixture so withdrawn and pumped is at least six times the combined volume of said chamber and all conduits and other chambers through which said mixture is withdrawn and pumped.

7. The improvement according to claim 5 wherein said gas and air mixture is withdrawn from a plurality of first ports in said sealed-off chamber and is pumped back into said sealed-off chamber through a plurality of second ports, each of said second ports being distant from at least one of said first ports.

8. The improvement according to claim 7 wherein said gas other than air has a lower permeability through said ball halves than air, and said withdrawal and pumping of said mixture of gases is continued until the volume of said mixture so withdrawn and pumped is at least six times the combined volume of said chamber and all conduits and other chambers through which said mixture is withdrawn and pumped.

9. Apparatus for rapidly distributing a first gas throughout a chamber that contains a mixture of a first gas and a second gas and is sealed from the atmosphere, said chamber being defined by the sections of a mold for joining together ball halves and by a plurality of said ball halves lodged in cavities in said mold sections, said mold sections being in a position in which the edges of said ball halves are near to but not engaging each other, and the outer peripheries of said mold sections being in sealing engagement with one another, comprising a conduit communicating at one end with said chamber at a first port and communicating at its other end with said chamber at a second port that is distant from said first port to form a closed loop for circulating said mixture of gases through said chamber and said conduit, and means in said conduit for pumping said mixture of gases through said conduit and said chamber.

10. The apparatus according to claim 9 wherein there is placed in said conduit means for measuring the flow rate of said mixture of gases flowing through said conduit.

11. In an apparatus for pressurizing tennis ball centers having two mold sections containing mold cavities in which are lodged halves of said tennis ball centers, said mold sections holding the edges of said tennis ball center halves near to but not engaging each other, said mold sections having their outer peripheries in sealing engagement with one another so as to form a closed chamber between said mold sections, said apparatus also having means for introducing a gas into said closed chamber to mix with the air in said chamber, the improvement comprising a gas recirculating conduit communicating at one end with said chamber at a first port and communicating at its other end with said chamber at a second port distant from said first port to form a closed loop for circulating said mixture of gases through said chamber and said conduit, and means in said conduit for pumping said mixture of gases through said conduit and said chamber.

12. The improvement according to claim 11 wherein there is placed in said conduit means for measuring the flow rate of said mixture of gases flowing through said conduit.

13. The improvement according to claim 11 wherein said conduit is divided into a plurality of legs at each end, the legs at one end communicating with said chamber at a plurality of first ports and the legs at said other end communicating with said chamber at a plurality of second ports, each of said second ports being distant from at least one of said first ports in said chamber.

14. The improvement according to claim 13 wherein there is placed in said conduit means for measuring the flow rate of said mixture of gases flowing through said conduit.

* * * * *